United States Patent [19]

Jacobson et al.

[11] 4,432,676

[45] Feb. 21, 1984

[54] VEHICULAR MOBILE HIGH CAPACITY PNEUMATIC CONVEYOR

[75] Inventors: Wayne M. Jacobson, York; Roger L. Quaintance, Henderson, both of Nebr.

[73] Assignee: Cyclonaire Corporation, Henderson, Nebr.

[21] Appl. No.: 339,479

[22] Filed: Jan. 15, 1982

[51] Int. Cl.[3] ..... B65G 53/40

[52] U.S. Cl. ..... 406/39; 406/115

[58] Field of Search ..... 406/39, 41, 52, 115, 406/116, 109, 153, 38, 23

[56] References Cited

U.S. PATENT DOCUMENTS

| | | | |
|---|---|---|---|
| 3,690,731 | 9/1972 | Mylting | 406/115 X |
| 3,953,077 | 4/1976 | Kulyabko et al. | 406/23 |
| 4,221,506 | 9/1980 | Shapunov et al. | 406/115 |

*Primary Examiner*—John J. Love
*Assistant Examiner*—L. E. Williams
*Attorney, Agent, or Firm*—Welsh & Katz

[57] ABSTRACT

A mobile vehicular mounted pneumatic conveying apparatus is disclosed which comprises a self-propelled vehicle having an elongated boom capable of being elevated and rotated relative to the vehicle, with the boom having a nozzle structure mounted on the other end thereof for engaging dry particulate material to be conveyed. The apparatus also has a material transfer assembly which includes at least one closed vessel for receiving material from said nozzle under vacuum pressure and for subsequently expelling material into a conveying line under positive pressure. The transfer assembly can be easily removed from the vehicle and a rearward carriage that is attached to the transfer assembly can similarly be removed. The apparatus is particularly adapted for conveying large quantities of dry, particulate material such as Portland cement from a large horizontal storage building as opposed to a vertical silo or the like. Support equipment is preferably located externally of the building and a unique distribution system for supplying positive and vacuum pressure to various distribution ports enables a very large surface area to be covered by selectively connecting the apparatus to one of the sets of ports during operation.

8 Claims, 4 Drawing Figures

VEHICULAR MOBILE HIGH CAPACITY PNEUMATIC CONVEYOR

The present invention is generally related to pneumatic conveying apparatus and, more particularly, to a large scale pneumatic conveying apparatus that is movable about the floor of a large storage building containing dry particulate material, such as Portland cement, or the like.

Pneumatic conveying apparatus is being increasingly used to move dry particulate material from one location to another during processing, as well as for unloading a transport container into a permanent storage container or building. One use of pneumatic conveying equipment that is particularly advantageous is that of moving dry Portland cement from the hold of a ship or barge to a storage container at a dockside or the like. Pneumatic conveyors are also used to convey the cement to a batch plant or mixer. It has been conventional practice to store Portland cement in a vertical manner, i.e., in silos or other large vertically oriented storage tanks or the like, which are necessarily quite expensive. It has been found that by storing cement on a concrete slab of a horizontal building, the cost of the storage building is significantly reduced to a fraction of conventional vertically oriented containers. However, when the concrete is stored in such horizontal manner, the logistics of moving the same to a batch plant for producing concrete is made more difficult for obvious reasons. Since a terminal operator large scale ready mix operation may require movement of literally tons of the dry Portland cement per hour, a large scale means of moving the same is necessary. Also, since the area over which the concrete may be stored may be several thousand square feet, a pneumatic conveying system that is capable of moving the concrete from any location in this area represents a substantial problem.

Accordingly, it is an object of the present invention to provide a pneumatic conveying system that is capable of moving dry particulate material from a large horizontal surface area to a remote location in a manner that is efficient in terms of cost and time, considering the large quantities that may be involved.

Another object of the present invention is to provide an apparatus of the foregoing type which is mobile in the sense that it can remove material from a pile which may be several tens of feet high and which may extend over several thousand square feet of horizontal area.

Another object of the present invention is to provide an apparatus of the foregoing type which is safe during operation in that it removes material from the top of a pile of material and also does so with an enclosed system that minimizes the amount of dust that an operator is exposed to.

Yet another object of the present invention is to provide an apparatus of the foregoing type which is self-propelled and which employs a boomed vehicle and wherein the pneumatic conveying equipment that is associated with the apparatus can be relatively easily removed to permit the vehicle to be operated as a crane for other non-related uses, if desired.

Still another object of the present invention is to provide a mobile apparatus of the foregoing type which requires support equipment for powering the pneumatic conveying equipment, wherein the support equipment can be relatively permanently deployed in a remote location and wherein an air distribution system and conveying line can be distributed over the surface area of the storage building and provide multiple sets of connection ports for the air supply lines and the conveying lines, any one set of which can be connected to the conveying equipment within the building.

Other objects and advantages will become apparent upon reading the following detailed description, while referring to the attached drawings, in which.

DETAILED DESCRIPTION

Figure 1:
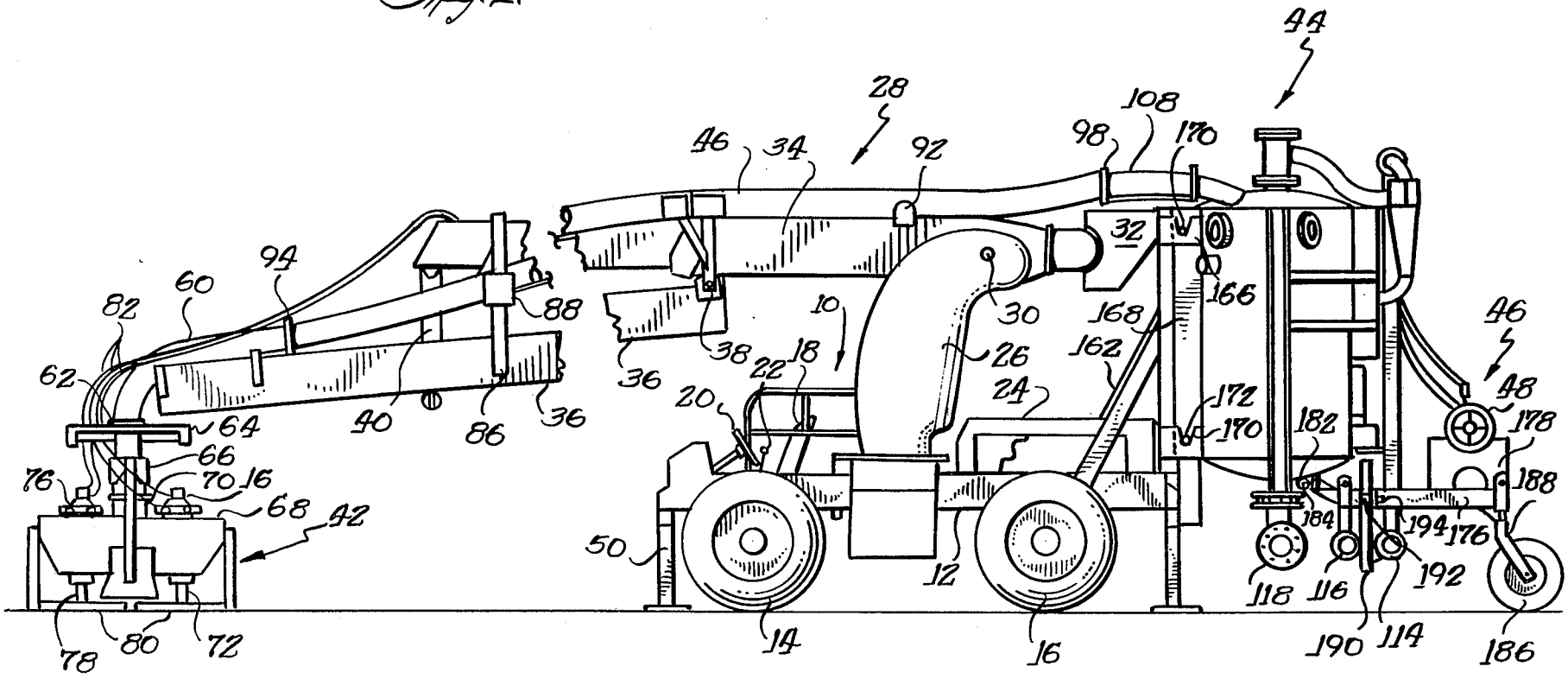
FIG. 1 is a side elevation of apparatus embodying the present invention.

Broadly stated, the present invention is directed to a pneumatic conveying apparatus of extremely large scale that is particularly adapted for use in conveying large quantities of dry particulate material per hour, such as dry Portland cement or the like. Heretofore, equipment having the extremely large throughput capacity of that contemplated by the apparatus disclosed herein has been generally permanently installed at a dock or rail-side location and is employed to move the material from one location to another wherein the input location is relatively confined. For example, if ships or barges are to be unloaded, the pneumatic conveying apparatus may be placed adjacent a dock and the holds that are unloaded are brought into the immediate location where the equipment can reach the material and convey it to separate storage facilities. Similarly, if the material is being transported in railcars, then each railcar can be unloaded and the conveying apparatus can then convey it to the storage location. Portland cement has been traditionally stored in large, vertical storage tanks or silos so that the force of gravity will cause the cement to gravitate toward a single outlet to which conveying equipment can be connected and thereby convey the cement to a batch plant mixer or the like. Such vertical storage facilities are extremely expensive compared to horizontal storage facilities. For example, dry Portland cement can be stored on the slab foundation of a large surface area storage building and it can be piled several tens of feet high over a surface area that may encompass several hundred, and even several thousand, square feet. It should be readily apparent that if cement is stored on a slab surface that covers an area of several thousand square feet, it will not be possible to have the cement gravitate toward a single outlet as is possible when the cement is stored generally vertically. Therefore, other means for removing the cement is necessary and it is to this end that the present invention is directed.

The present invention has the advantage of being able to convey large quantities of cement in a relatively short time and also has the distinct advantage of being mobile in the sense that it is adapted to convey cement from a supply that can extend over a very large surface area. The apparatus is mobile in the sense that it is self-propelled and is therefore movable over the entire surface area and has an input nozzle structure that is carried by an elevatable and horizontally movable boom mounted to the self-propelled vehicle and the combination of movement of the vehicle and the boom enables material to be engaged at virtually any elevation from the top of the pile to the floor of the storage building.

Conveying lines from the vehicle can be extended to any one of a number of sets of distribution ports that are preferably strategically located near the ceiling of the building. The apparatus is capable of being coupled and uncoupled to permit the apparatus to operate in any desired area within the storage building. The sets of distribution ports provide supplies of positive air pressure, as well as vacuum pressure, and a conveying line for the material itself and sets of these ports are then interconnected with one another and to sources of positive and vacuum pressure as well as to the end point to which the material itself is to be conveyed. Since the sources of positive and vacuum pressure can be supplied by conventional air compressors and vacuum pumps, they can be conveniently located externally of the building if desired, in non-interfering relation with the interior of the storage building and with the mobile self-propelled vehicle itself.

It should be understood that while it is preferred to leave the conveying lines and sources of positive and vacuum pressure located near the ceiling, it is quite possible for such lines to be located in the floor and distribution ports would be also located in the floor as well. In certain instances the lines may be conveniently located in one or more side walls of the building.

The vehicle includes a transfer assembly having at least one closed vessel which receives the material from a nozzle structure via a conveying line under vacuum pressure and when the vessel is filled, the material can be expelled from the vessel into the conveying line under positive pressure. A desirable attribute of the apparatus described herein lies in the fact that the nozzle structure, conveying line from the nozzle structure to the transfer assembly as well as the transfer assembly can be relatively easily removed from the self-propelled vehicle and the self-propelled vehicle and a portion of the boom can then be used as a conventional crane when it is not being employed for conveying. Of particular significance is the fact that the boom portion attached to the self-propelled vehicle can be used to disassemble the transfer assembly from the vehicle and no other equipment is needed for such disassembly.

Turning now to the drawings, and particularly FIG. 1, the pneumatic conveying apparatus is illustrated and includes a self-propelled vehicle, indicated generally at 10, which includes a main frame 12, front and rear wheels 14 and 16, respectively. A driver's seat 18, steering wheel 20 and operating levers 22 are located near the front portion thereof and an engine 24 is located rearwardly thereof. In the center is a turntable mounted rotatable boom base support 26 to which an elongated boom 28 is attached and which is vertically pivotable about a pivot pin 30. A counterweight 32 is located near the rear thereof for counter-balancing the weight of the boom 28 that is attached to it. The boom 28 haa first section 34 which is permanently attached to the base support 26 and a second section 36 that is connected thereto by means of a removable pin 38 and a cable 40 which can be controlled to lower the section 36 relative to the pin 38. The section 36 can be removed from the section 34 if desired and a hook can be attached to the cable 40 for using the boom as a standard crane and for purposes other than pneumatic conveying.

A nozzle assembly, indicated generally at 42, is attached to the outer end of the boom portion 36 for engaging the dry particulate material that is to be conveyed and the material is drawn into the nozzle under vacuum pressure. A transfer assembly 44 is attached to the rear end of the vehicle 10, i.e., to the right as shown in FIG. 1 and the transfer mechanism receives the material from the nozzle assembly via a conduit, indicated generally at 46, which comprises conduit portions that are flexible and other portions of which are rigid. The transfer assembly 44 is removably attached to the frame 12 of the vehicle 10 so that the vehicle with boom portion 34 can be used as a conventional crane if desired. The transfer assembly 44 also includes a carriage assembly, indicated generally at 46, which in turn can be separated from the transfer assembly if desired, with the carriage assembly 46 carrying one or more hydraulic pumps 48 which supply the hydraulic fluid pressure for operating the valves incorporated into the transfer assembly 44 and for driving hydraulic motors associated with the nozzle assembly.

During operation, the boom 28 can be elevated by hydraulic control so that the nozzle assembly can engage the dry particulate material, and the entire boom and nozzle assembly can be moved to the left or right by rotating of the turntable-mounted base support 26 as desired. The vehicle 10 has hydraulic outriggers 50 located on opposite sides of both the front and rear of the vehicle to stabilize the apparatus when the boom is being moved during operation. In one preferred embodiment, the length of the entire apparatus shown in FIG. 1 may be approximately 63 feet which, when the boom assembly is elevated, permits the nozzle to engage a pile of material that may exceed 25 feet in height. As the pile is depleted, the boom can be lowered to the ground elevation as shown so that all of the material in a particular area can be conveyed.

The foregoing detailed description describes the apparatus in relatively broad terms and the apparatus will now be described in more detail, beginning with nozzle assembly 42, which in and of itself is not a part of the present invention. The nozzle assembly 42 has a rigid steel elbow 60 which is preferably bolted, but which can be attached by some other means to the outer end of the boom portion 36 and the elbow 60, in addition to supporting the nozzle assembly 42, provides a pathway through which the material is conveyed back to the transfer vessel assembly 44. The lower portion of the elbow 60 has a flange 62 to which a gimbal structure 64 is attached and which permits the lower gimbal supported portion of the nozzle structure to be universally pivotable so as to maintain a generally level orientation. The gimbal structure 64 is attached to a frame 66 to which a platform 68 is attached via a steel conduit length 70 and the lower portion of the conduit 70 has an opening generally at the elevation indicated at 72 to permit the dry particulate matter to be conveyed upwardly. A flexible length of conduit 74 interconnects the conduit length 70 with the flange 62 of the elbow to provide a continuous path through which the material flows. A pair of hydraulic motors 76 have output shafts 78 attached to circular spinners 80 which have blades (not shown) which are rotated when the hydraulic motors 76 are operated for the purpose of loosening the material so that it will readily enter the inlet opening 72 for conveying. The hydraulic motors 76 are powered by hydraulic fluid that is transmitted to them through hydraulic lines 82 that extend back along the boom to the hydraulic pump 48. Four removable corner located steel pipes 84 are provided to permit the nozzle assembly 42 to be lowered to ground level and to support the mechanism so the spinners 82 will not sustain the full weight of the mechanism when the boom is lowered to the elevation as shown.

As previously mentioned, the lower boom extension 36 is attached to the boom portion 34 by means of the removable pin 38 and the cable 40. The pair of guide members 86 are attached to the lower boom extension 36 on opposite sides thereof and the guide members extend vertically to be in close relation to the sides of the upper boom 34 and provide the requisite resistance to side thrust during operation. A support bracket 88 is preferably welded to one of the guide members 86 for the purpose of supporting the conveying line 46. Other supports 90 and 92 are spaced along the upper boom portion 34 for the same purpose. The conveying line 46 as previously mentioned, is partially flexible and partially rigid. The elbow 60 has a second flange 94 located on its opposite rightward end to which a flexible hose having a cooperating flange is attached. The flexible hose is of the same diameter but permits necessary movement between the two portions of the boom 28 during operation. The hose has its opposite end terminated in a flange 96 that is also bolted to a flange 98 of a rigid Y fitting which is adapted to feed the material into either of the two tanks of the transfer vessel assembly that will be hereinafter described.

As previously mentioned, it is possible to separate the lower portion of the boom as well as the nozzle assembly 42 from the boom portion 34 so that the vehicle can be used as a conventional crane. When such is done, it is only necessary to decouple the flanges 96 and 98 and remove the hose from the supports 88, 90 and 92. The boom can be lowered and independently supported and the pin 38 can be removed and the cable 40 drawn out so that it can be detached. Since the guides 86 are freely movable relative to the boom portion 34, there is no other attachment that would preclude removal of the lower boom from the upper boom portion 34. It should be appreciated that the boom may be comprised of a single structure rather than the two sections as specifically shown. In such event, the elbow 60 will be removable from the boom by a few bolts. With this operation, the nozzle assembly and conveying line can be removed and the boom can be used for other purposes as has been described.

Figure 2:
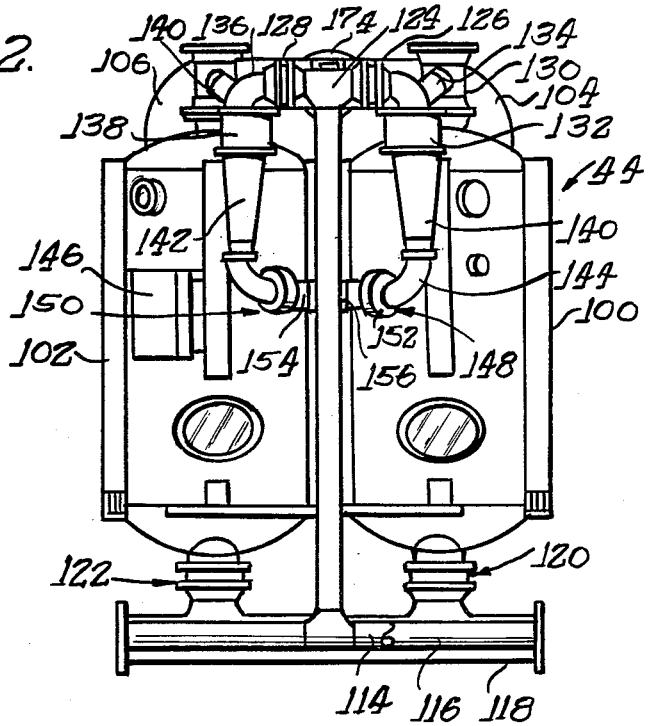
FIG. 2 is a rear view of the transfer assembly portion of the apparatus shown in FIG. 1.
Figure 3:
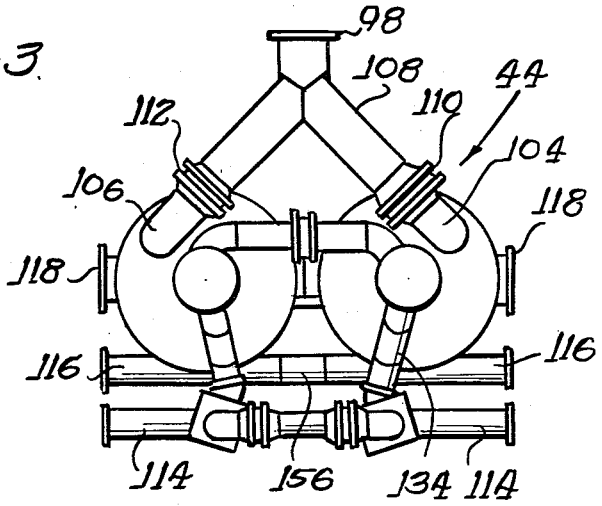
FIG. 3 is a top plan view of the transfer assembly shown in FIGS. 1 & 2.
Figure 4:
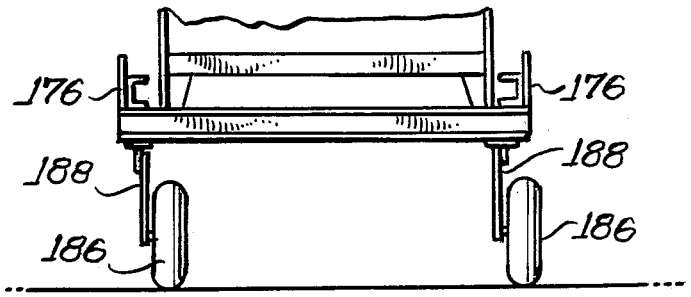
FIG. 4 is a rear view of only the carriage structure shown in FIG. 1.

Turning now to the transfer vessel assembly 44 and referring to FIGS. 1, 2 and 3, it comprises a pair of closed vessels 100 and 102 which have respective inlets 104 and 106 that are connected to receive material from the nozzle via the hose 46 and a rigid Y section 108 when one of the inlet valves 110, 112 is opened. The purpose of the two closed vessels 100 and 102 is to permit "push-pull" operation, in that material can be fed into one of the vessels while the other expels material into the output conveying line. It should be understood that the construction and operation of the transfer vessel assembly in and of itself does not comprise the invention described herein. As previously mentioned, material is fed into the closed vessels under the influence of vacuum pressure and is expelled therefrom by positive pressure. The assembly has a vacuum conduit 114 which extends to opposite sides of the assembly and is adapted for connection to a source of vacuum pressure via a hose that is not shown. If the hose is connected to the right side of the conduit 114, then a cover plate is attached to the opposite ended opening to seal the conduit. Another conduit 116 is shown adjacent the conduit 114 and conduit 116 is appropriately connected to a source of positive air pressure by another flexible hose that is also not shown. Conduit 116 can also be connected to the source of positive air from either side thereof and a similar cover plate is placed on the end opposite the end that is connected to the hose carrying the positive pressure supply. The outlet of the transfer assembly comprises yet another but preferably larger conduit 118 that can also be connected to a flexible conveying hose from either end and it too has its opposite end sealed by a cover plate. The bottom of each of the vessels 100 and 102 is connected to the material outlet conduit 118 via respective outlet valves 120 and 122 which are opened to expel material into the conveying line after that particular vessel has been filled.

To load one of the vessels, the vacuum line 114 extends vertically to a T connector 24 where it is connected to suction valves 126 and 128. The suction valve 126 is in turn connected to the vessel 100 via an elbow 130, a T fitting 132 and conduit length 134. Similarly, the valve 128 is connected to elbow fitting 136, T fitting 138 and conduit length 140 to the vessel 102. The T fittings 132 and 138 are connected through respective dust collectors 140, 142, elbows 144 and 146 and discharge valves 148, 150 to conduits 152 and 154. These conduits are connected in a T fitting 156 that is in communication with the positive supply line 116.

During operation, when material is to be loaded into one of the vessels, e.g., vessel 100 (while the other vessel is being unloaded), valve 126 is opened as is inlet valve 110, and valves 112, 128 and 152 are closed so that vacuum pressure would be communicated to the interior of the vessel 100 and cause it to move material into the vessel to fill it. While vessel 100 is being filled, vessel 102 which was previously filled, is then expelled of material into the conveying line 118. This is done by opening valve 122 while closing the input valve 112 and applying positive fluid pressure to the interior of the vessel 102 by opening valve 150 while closing valve 128. By sequencing between filling and expelling material from the vessels, with the opposite operation being performed in the opposite vessel, the material can be generally continuously conveyed as a result of the "push-pull" type of operation.

In accordance with an important aspect of the present invention the entire transfer vessel assembly is a unitary structure that is removably attached to the vehicle if desired. As is best shown in FIG. 1, the frame 12 of the vehicle contains a pair of vertically oriented structural members 160 as well as support braces 162 which are attached at opposite ends to the frame 12 and to the vertical support members 160. The support members include upper and lower yokes 164 and 166 positioned on opposite sides of the frame and the transfer assembly 44 also has a structural member 168 preferably welded thereto with pin members 170 extending outwardly thereof adapted to engage corresponding slotted openings 172 in the yokes. Since both sides of the apparatus have the cooperating pin and yoke interconnections, there are a total of 4 pins which fit into corresponding slots of the yokes and these 4 connection points adequately support the transfer vessel assembly 44 on the vehicle 10. In the event that it is desired to remove the transfer assembly, a structural loop 174 (FIG. 2) is provided for attachment by a hook attached to the cable 40. The boom of the vehicle can therefore provide the lifting mechanism for removing the transfer vessel assembly 44 by merely lifting the assembly so that the pins are disengaged from the slots and the transfer assembly can then be laid on its side. However, it should be appreciated that the carriage assembly 46 that is attached to the assembly 44 must be removed before the transfer assembly is removed from the vehicle.

The carriage assembly 46 has a generally square frame comprised of side frame members 176, rear cross member 178 and a front cross member 180. The frame structure is attached to the transfer assembly by means of a pintle 182 that cooperatively engages a hook 184 and the pintle-hook arrangement is present on both sides of the apparatus so as to support the carriage assembly from opposite sides. The frame has a pair of rear wheels 186 which are supported by a bracket 188 that is attached to the frame in a manner whereby it can pivot horizontally and enable the carriage to move freely when the vehicle is moved. The pintle-hook connection to the transfer vessel assembly 44 not only permits the carriage to move vertically relative to the transfer assembly 44 so as to accomodate elevation changes in the terrain over which the apparatus moves, but the pintle 182 can be unlocked to have the hook removed so that the entire carriage can be easily separated from the transfer vessel assembly 44 before removing the transfer vessel assembly 44 from the vehicle itself. It should of course be understood that the hydraulic lines from the hydraulic pump and other interconnecting control lines or the like must be separated before the carriage is removed from the transfer assembly 44.

Each side of the carriage assembly 46 also has a round pipe 190 that is slidingly coupled inside a sleeve 192 that is preferably welded to the side frames 176. A threaded bolt 194 which functions as a set bolt will retain the pipe 190 in an upward retracted position as shown in FIG. 1. When the carriage is to be removed from the transfer vessel assembly 44, the rear outriggers 50 can be manipulated to slightly raise the entire rear end of the apparatus so that the pipe can be extended downwardly and the set bolt 194 tightened so that when the pintle is released, and the rear outriggers are manipulated to lower the rear end of the apparatus, the carriage assembly will be free-standing and once the various lines are disconnected from the hydraulic pump, the vehicle can merely be moved forwardly leaving the free-standing carriage assembly.

From the foregoing detailed description it should be appreciated that a large-scale pneumatic conveying apparatus has been described which is capable of moving over extremely large areas during operation and which can easily convey material from piles that may exceed 25 feet or more. The unusual mobility of the apparatus is conducive to extremely efficient conveying. Since the conveying line itself may be on the order of 10 inches in diameter, very large quantities of material can be moved in a relatively short time. The unique design of the apparatus permits the conveying portion of it to be removed so that the self-propelled vehicle can be used as a conventional crane during those times when conveying is not being done.

It should be understood that while prepared embodiments of the present invention have been described herein, various modifications, alternatives and substitutions will be apparent to those skilled in the art, and accordingly, the scope of the present invention shall be defined only by the appended claims and equivalents thereof.

Various features of the present invention are set forth in the following claims.

What is claimed is:

1. A mobile vehicular mounted pneumatic conveying apparatus, comprising:

a self-propelled vehicle having an elongated boom structure capable of being elevated and rotated relative to the vehicle;

a nozzle structure mounted to the outward end portion of said boom structure, said nozzle structure having a gimbal mounting to maintain a gimbal supported lower portion relatively level, said lower portion having at least one rotatable member for loosening the material to facilitate entry thereof into said nozzle structure;

a material transfer assembly including at least one closed vessel for receiving material under vacuum pressure and for subsequently expelling the material under positive pressure;

a conveying line interconnecting said nozzle structure and said transfer assembly;

said vehicle and said transfer assembly having a number of releasable connections to permit said transfer assembly to be removed from said vehicle;

said transfer assembly including a carriage structure having one end pivotally attached to said vessel, the opposite end thereof having at least one wheel for partially supporting the carriage structure.

2. Apparatus as defined in claim 1 wherein said boom structure comprises two boom members, a first of which is attached to said vehicle structure, the second of which is removably attached to said first structure, the outer end portion thereof being permanently connected to said nozzle structure, said first and second boom members being separable from one another, each of said boom structures including support members for supporting said conveying line interconnecting said nozzle structure and said transfer structure.

3. Apparatus as defined in claim 2 wherein said nozzle structure includes a right-angled rigid conveying member to which said gimbal mounting is attached, said conveying line being flexible and attached to said rigid conveying member at the nozzle structure, the opposite end thereof being attached to said transfer assembly.

4. Apparatus as defined in claim 1 wherein said vehicle includes a vertically oriented frame structure attached to said vehicle, said releasable connections comprising a plurality of yoke members attached to said frame structure, said transfer assembly having a corresponding plurality of outwardly extending members for engaging the yoke members when said transfer assembly is carried by said vehicle, said transfer assembly being capable of being lifted from said vehicle by the boom structure for removing the transfer assembly from said vehicle.

5. Apparatus as defined in claim 1 wherein said carriage structure has a pintle and hook connection on opposite sides of said carriage structure for pivotally connecting the same two said transfer assembly.

6. Apparatus as defined in claim 5 wherein said carriage structure includes two wheels located on opposite sides of the rear portion of said carriage structure, said wheels being mounted on horizontally pivotable wheel mounting brackets to permit free movement of said carriage structure when said vehicle is moved.

7. Apparatus as defined in claim 5 wherein said vehicle includes a plurality of hydraulically operated outriggers for providing stability for said apparatus when boom structure is rotated away from its forward position, the rearward outriggers being capable of lifting the transfer structure and forward end of said carriage structure a small amount, said carriage structure including a pair of jack stands that are capable of being lowered to thereby support the carriage structure and facilitate disconnection of said pintle and hook connections.

8. Apparatus as defined in claim 1 wherein said carriage structure carries an electrically operated hydraulic pump for providing the hydraulic pressure needed to operate the transfer assembly.

* * * * *